US006745924B2

(12) United States Patent
Woodworth

(10) Patent No.: US 6,745,924 B2
(45) Date of Patent: Jun. 8, 2004

(54) HANGER FOR CLOTHING ITEMS

(76) Inventor: Peter Michael Woodworth, 3 Camrose Close, Connah's Quay Clwyd CH5 4TL (GB)

( * ) Notice: Subject to any disclaimer, the term of this patent is extended or adjusted under 35 U.S.C. 154(b) by 0 days.

(21) Appl. No.: 10/007,722

(22) Filed: Nov. 13, 2001

(65) Prior Publication Data

US 2002/0104858 A1 Aug. 8, 2002

Related U.S. Application Data

(63) Continuation of application No. PCT/GB00/01403, filed on Apr. 20, 2000.

(51) Int. Cl.[7] ..... A41D 27/22
(52) U.S. Cl. ..... 223/87
(58) Field of Search ..... 223/87, 85, 90, 223/91, 93

(56) References Cited

U.S. PATENT DOCUMENTS

| | | | | | |
|---|---|---|---|---|---|
| 3,924,303 | A | * | 12/1975 | Elliott | 24/536 |
| 4,308,981 | A | * | 1/1982 | Miura | 223/96 |
| 4,566,157 | A | * | 1/1986 | Packendorff | 24/536 |
| 4,716,634 | A | | 1/1988 | Fan | |
| 5,183,191 | A | * | 2/1993 | Garrison et al. | 223/91 |
| 5,584,421 | A | * | 12/1996 | Blanchard et al. | 223/85 |
| 5,890,634 | A | * | 4/1999 | Zuckerman et al. | 223/96 |

FOREIGN PATENT DOCUMENTS

| | | | |
|---|---|---|---|
| BE | 737 635 | | 2/1970 |
| DE | 833 108 | | 3/1952 |
| FR | 2 592 291 | | 7/1987 |
| GB | 2044096 A | * | 2/1980 |
| GB | 2 044 096 A | | 10/1980 |

* cited by examiner

*Primary Examiner*—John J. Calvert
*Assistant Examiner*—James G Smith
(74) *Attorney, Agent, or Firm*—Woodard, Emhardt, Moriarty, McNett & Henry LLP

(57) ABSTRACT

A clip hanger comprises a hollow body (16) slidably retaining a clamping member (18) providing a pair of jaws (20). The clamping member being slidable into the body to close the jaws.

22 Claims, 4 Drawing Sheets

HANGER FOR CLOTHING ITEMS

CROSS-REFERENCE TO RELATED APPLICATIONS

This application is a continuation of prior application PCT/GB00/01403, filed on Apr. 20, 2000 designating the United States of America and published in English, which claims the benefit of United Kingdom (GB) Patent Application Serial No. 9909435.1 filed Apr. 24, 1999. Both applications are incorporated by reference in their entirety.

BACKGROUND OF THE INVENTION

This invention concerns a hanger suitable for use in displaying clothing items.

There are various types of clip hanger for clothing items. One type has a pair of jaws connected by a U-shaped metal spring member, so that the jaws are normally urged closed to grip an item of clothing. Extensions of the jaws above the spring can be squeezed together to open the jaws and release the item of clothing. These clips may be provided individually or as a pair mounted on opposite ends of a cross bar having a supporting hook. The clips may be slidable along the crossbar.

The pressure required to open the jaws can, however, be quite excessive for children and the elderly making it difficult for them to remove and replace items of clothing.

Another type of clip hanger has a pair of hingedly connected jaws and a U-shaped metal member having a longer limb slidably retained on one of the jaws with its shorter limb arranged to slide over the other jaw to urge it towards the first jaw to close them when the U-shaped member is pushed towards the open end of the jaws. To open the jaws, the U-shaped member is slid in the opposite direction.

This type of clip may be provided singly with a hook for suspending the clip from a rail or the like but is more commonly provided in pairs on a hanger crossbar.

Both of the above prior art clips are made of plastics and metal components rendering them difficult to recycle.

GB 2044096 discloses a clip hanger comprising a hollow body slidably retaining a clamping member providing a pair of jaws, the clamping member being slidable through the body to close the jaws.

SUMMARY OF THE INVENTION

An object of this invention is to provide a clip hanger that may be made of one material rendering it easier to recycle.

Another aspect of this invention is to provide a clip hanger that does not require excessive force to open and close.

According to this invention there is provided a clip hanger comprising a hollow body slidably retaining a clamping member providing a pair of jaws, the clamping member being slidable into the body to close the jaws.

The clamping member is preferably a resilient member and especially a U-shaped member and is preferably sized so that the action of pushing the clamping member into the body squeezes the jaws towards each other. When the clamping member is pulled outwards of the body, the jaws are free to open out. Thus, any item of clothing may be attached to the hanger by inserting part of the clothing items between the jaws when at their outermost extent and pushing the clamp member into the body, whereupon the jaws close to grip that part of the clothing item between them.

It is to be understood that sliding of the jaws into the body may be achieved by movement of one of the body or of the jaws relative to other other.

Opposing faces of the jaws may be provided with gripping surfaces thereon such as by profiling of the faces of the jaws, by forming the jaws with textured faces or by addition of gripping material thereon, such as of rubber or synthetic elastomeric material, which itself may be profiled or textured.

The gripping surfaces of the jaws may have two gripping sections providing differential gripping forces.

Preferably the clamp is provided with a first gripping section at the free end of the jaws. The first gripping section may comprise pads, such as of rubber or foamed material, on the opposing inner surfaces of the jaws. Preferably, a stop member in the form of a projection extends from one of the jaws to provide a boundary for the first gripping section.

The second or further gripping section is preferably provided from the projection to an inner extremity of the inner surface of the jaws whereby the projection may act as a gripping element. The second gripping section may be profiled or ribbed for grip.

In this manner, the first gripping section furthest from the hinge of the jaws may be used to provide a relatively weak gripping force for gripping delicate lightweight garments, the garment being inserted into the clamp up to the stop member. Alternatively, a heavy garment may be inserted up to the hinge of the garment thereby being held by both the teeth of the first gripping section and the projection of the second gripping section.

It is to be appreciated that more than two gripping sections may be provided to provide a clamp having multiple gripping forces, for example by providing a series of spaced apart stop members/projections.

The clamping member may be provided with one or more stops thereon to limit the extent to which it can be pushed into the body. For a U-shaped clamping member a stop may be provided on an outer face of one or both limbs thereof to abut an edge or edges of the body.

At least one outer face of the clamping member may be provided with a thumb or finger receiving recess to facilitate operation of the clip hanger.

A preferred clip hanger according to the invention has both its body and clamp member made of plastics material. Thereby, the clip hanger is more easily recyclable than the prior art clip hangers made of metal and plastics components.

The body may be closed at one end or may be open at both ends. The latter option provides a possibility for the clamp member to be pushed outwardly of the body from the opposite open end of the body rather than relying on pulling the clamp member out by gripping the jaws or an item of clothing held in the jaws.

The clip hanger of the invention may be provided as a single item, say with a hook or the like on the body for supporting the hanger on a rail, rack or the like. Alternatively two clip hangers of the invention may be provided either fixed or slidably mounted on opposite ends of arms of a garment hanger, the hanger having a supporting hook generally centrally thereof.

The arms may be fixed or may be of an expandable hanger, such as of the type disclosed in my earlier patent application W099/17644.

BRIEF DESCRIPTION OF THE DRAWINGS

This invention will now be further described, by way of example only, with reference to the accompanying drawings, in which.

DESCRIPTION OF SELECTED EMBODIMENTS

Figure 1:
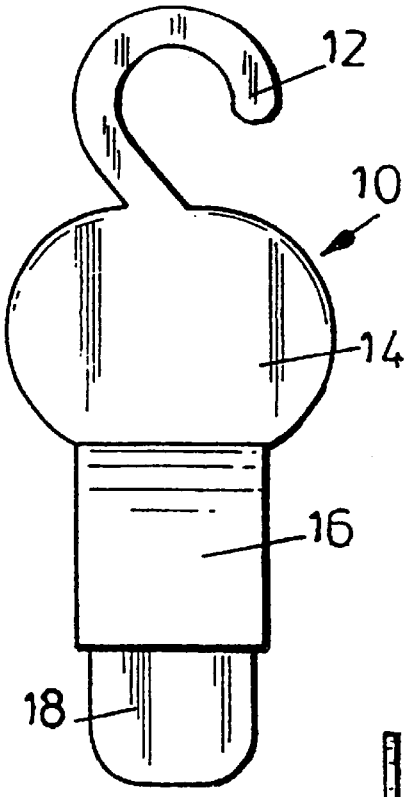
FIG. 1 is a front view of a first clip hanger of the invention.
Figure 2:
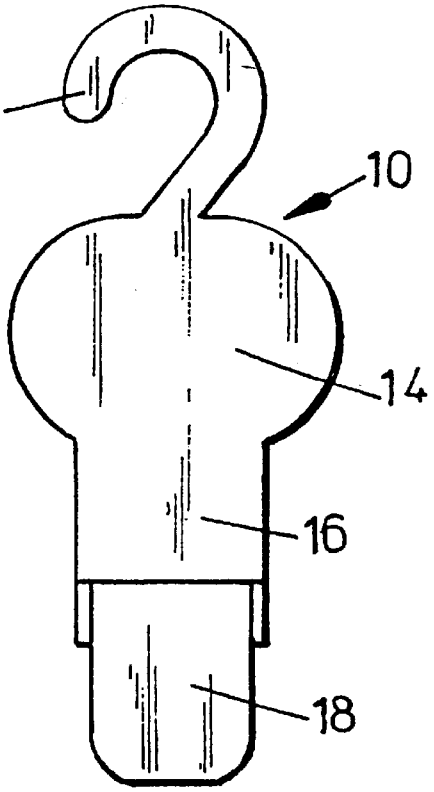
FIG. 2 is a rear view of the clip hanger of FIG. 1.
Figure 5:
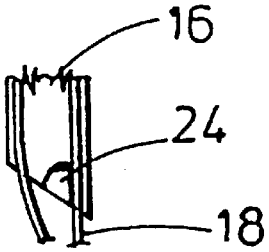
FIG. 5 is a partial section on line AA of FIG. 3.
Figure 3:
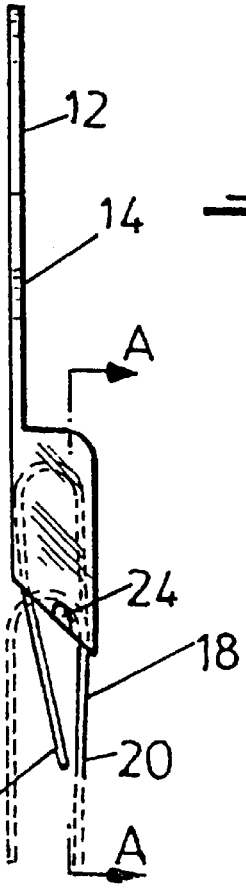
FIG. 3 is a side view of the clip hanger of FIG. 1.
Figure 4:
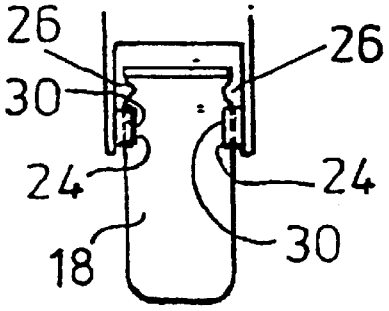
FIG. 4 is a partial internal side view of the clip hanger of FIG. 1.
Figure 6:
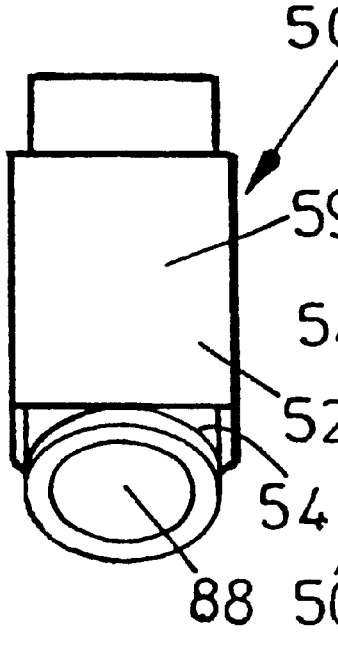
FIG. 6 is a front view of a second clip hanger.
Figure 7:
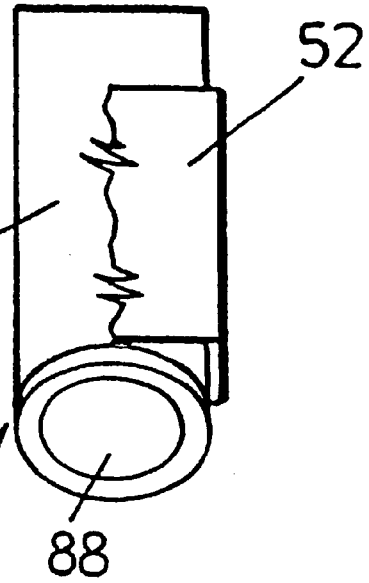
FIG. 7 is a partially cut away front view of the clip hanger of FIG. 6.
Figure 8:
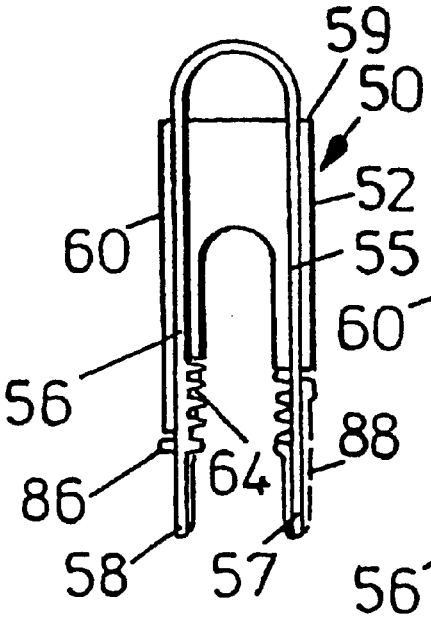
FIG. 8 is a section through the clip hanger of FIG. 6 closed.
Figure 9:
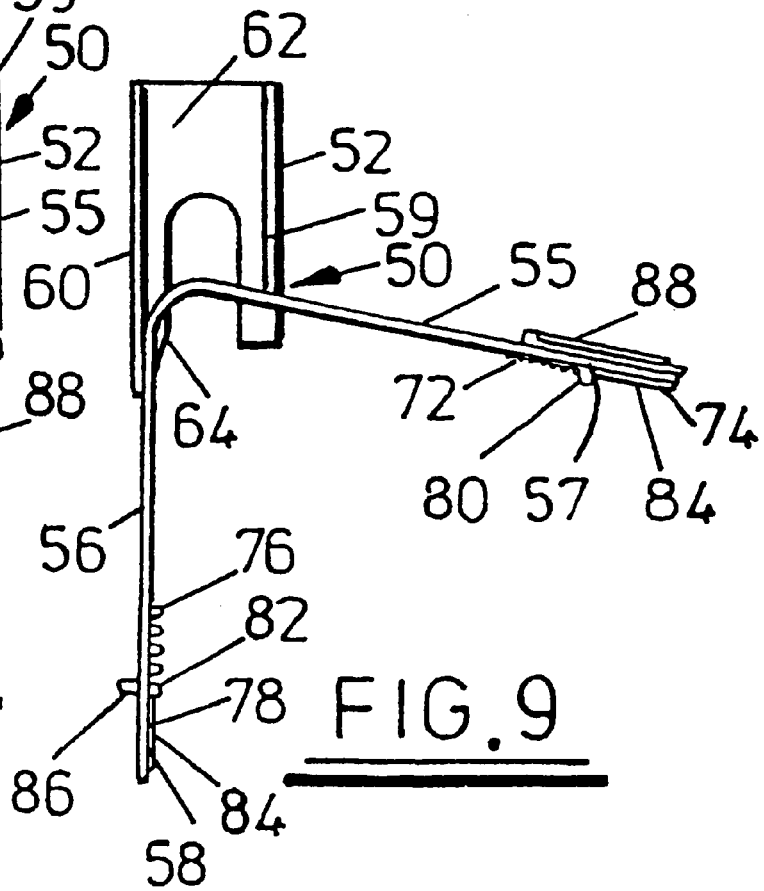
FIG. 9 is a section through the clip hanger of FIG. 6 open.

Referring to FIGS. 1 to 5 of the accompanying drawings a clip hanger 10 for clothing items has a hook 12, for supporting the hanger from a rail, rack or the like, extending from a shield 14, on which product information can be provided, typically in the form of an adhesive label.

Below the shield 14 is a rectangular section hollow body 16 which slidably retains a gripping member 18 of resilient plastics material.

The gripping member 18 is in the form of a U-shaped clamp providing a pair of to clamping jaws 20. The opposing surfaces of the jaws 20 may be profiled for extra grip.

The gripping member 18 is sized, so that when it is pushed into the body, the jaws are urged towards each other by opposing sides of the body. On the other hand, when the gripping member is pulled outwardly from the body, the jaws open.

The gripping member is retained in the body by means of stops 24 on opposing sides of the body, the base of the gripping member abutting against the stops when pulled outwardly to its fullest extent. To insert the gripping member into the body initially, the gripping member has notches 26 on opposed edges which allow it to be pushed past the stops which are themselves chamfered at 30 to ease passage of the gripping member into the body. Once the U-bend of the gripping member is past the stops 24, the gripping member is prevented thereby from being pulled completely out of the body.

The clip hanger is used by pulled outwardly the gripping member to open the jaws, in between which part of a clothing item can be inserted. The gripping member is then pushed back into the body to close the jaws and grip the items of clothing. The item of clothing can be removed from the hanger simply by pulling on the item of clothing. That action will pull the gripping member out of the body to open the jaws and release the clothing item.

The hook, shield, body and gripping member may all be made from plastics material, whereby recycling of the clip hanger is facilitated as different materials do not have to separate out.

Turning to FIGS. 6 to 9 of the accompanying drawings, a clip hanger 50 has a rectangular section hollow body 52 open at opposite ends. Slidably retained in the body is a resilient U-shaped clamping member 54 having limbs 55, 56 providing jaws 57 and 58 at its open end. The body has a front wall 59, rear wall 60 and side walls 62. On opposed sides 62, within the body 52 are lugs 64 spaced slightly from rear wall 60. One limb of the clamping member is slidably retained between those lugs and the rear wall of the body. The lugs 64 also act as stops to prevent the clamping member 54 from being pulled out of the body.

The jaws 56 and 57 have opposed gripping faces each having two gripping sections 72, 74 and 76, 78 respectively separated by transverse ribs 80 and 82 respectively. Upper gripping sections 72 and 76 are intended for gripping heavier clothing items and are ribbed to improve grip. Lower gripping sections 74, 78 are for lighter clothing or more delicate fabrics and have rubber or foam pads 84 thereon.

On the rear face of the limb 56 is an abutment 86, which limits the extent of movement of the gripping member into the body by contact with bottom edge of the rear wall 60 of the body. On the front face of the limb 55 is a finger or thumb plate 88, which also acts as an abutment, this time against the bottom edge of the front wall 59 of the body.

The clip hanger of FIGS. 6 to 9 operates more or less in the same manner as the embodiment of FIGS. 1 to 5 except that the jaws may be opened by pulling the clamping member out of the body from the top i.e. by pushing on the U-bend of the clamping member. Furthermore all of the components of the clip hanger 50 may be made from plastics material.

Figure 10:
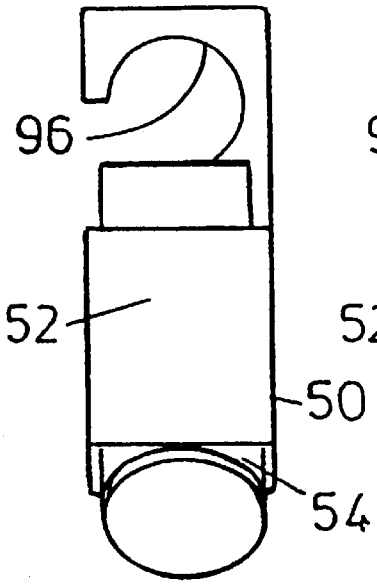
FIG. 10 is a front view of another embodiment of the invention closed.
Figure 11:
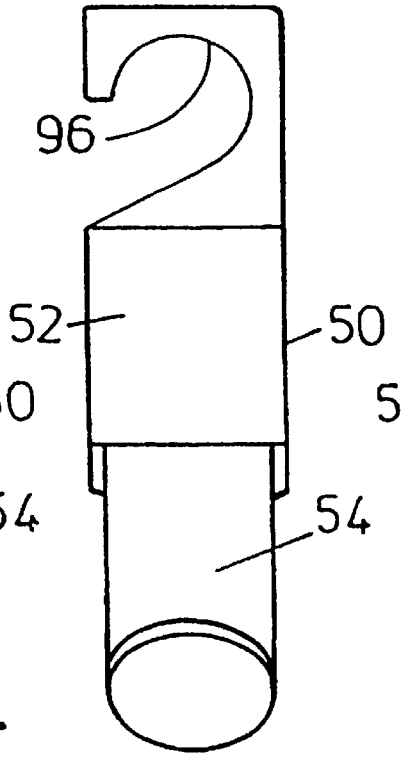
FIG. 11 is a front view of the embodiment of FIG. 10 partially open.
Figure 12:
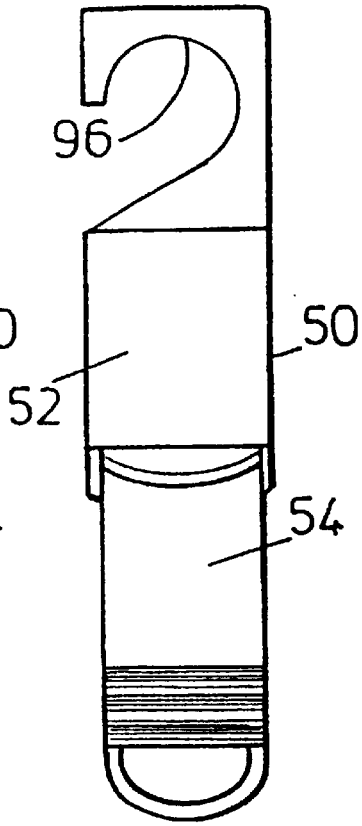
FIG. 12 is a front view of the embodiment of FIG. 10 fully open.

FIGS. 10, 11 and 12 show the same clip hanger as in FIGS. 6 to 9 but with a hook 96 provided as a continuation of rear wall 60 of the body.

Figure 13:
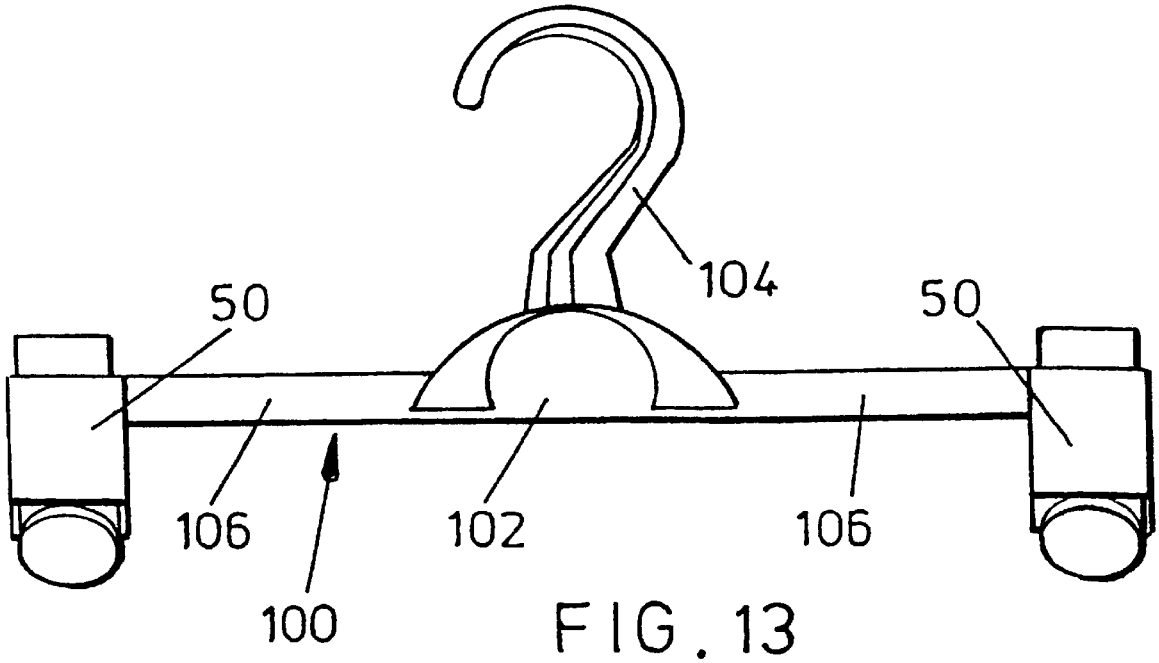
FIG. 13 shows a first garment hanger using clip hangers of the type shown in FIGS. 6 to 9.

In FIG. 13, a garment hanger 100 has a shield area 102 with a supporting hook 104 extending therefrom. Arms 106 extend from opposite sides of the shield and on the outer end of each arm are clip hangers 50 of the type shown in FIGS. 6 to 9. The clip hangers 50 are fixed, although it is possible to arrange for them to be slidable along their respective arms to adjust the distance between them to accommodate different sizes of garment.

An alternative stop for the jaws may be provided by an arm of a hanger through the body, i.e., the body 52 may be mounted on an arm 106 either fixedly or slidably with the jaws 56, 57 either side of the arm 106, so that it acts as a stop for the jaws. The stop may of course be a bar or the like within the body between the sides thereof and over which the jaws sit.

It may be possible in the hanger of FIG. 13, for example, to arrange for the jaws to be fixed to the arms and for the body to be movable to open and close the jaws.

Figure 14:
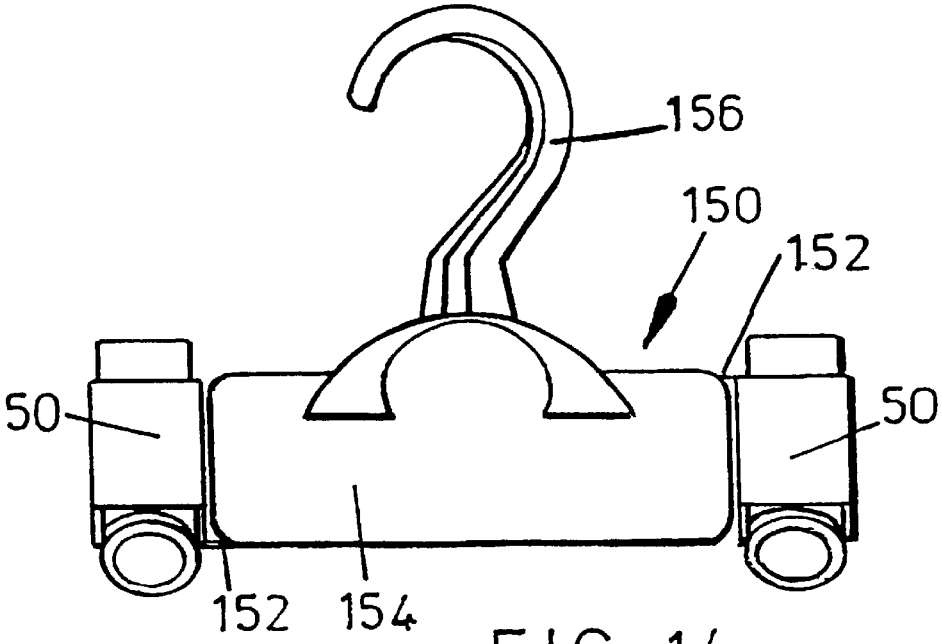
FIG. 14 shows a second garment hanger using clip hangers of the type shown in FIGS. 6 to 9.

FIG. 14 shows an expandable garment hanger 150 having a pair of arms 152 arranged to move in opposite directions to increase or decrease the overall length of the hanger arms. The arms are slidably mounted in a body 154 for that purpose. The body has a supporting hook 156. At the outermost end of each arm 152 is a clip hanger 50 of the type shown in FIGS. 6 to 9 of the drawings.

Both of the hangers of FIGS. 13 and 14 may be made entirely from plastics material to facilitate recycling.

What is claimed is:

1. A clip hanger comprising a hollow body slidably retaining a clamping member providing a pair of jaws, defining an open end of the clamping member, the clamping member being slidable in the direction of the open end of the clamping member to open the jaws and in the opposite direction to close the jaws, wherein the body includes one or more abutments to stop the clamping member being pulled from the body completely in the opening direction, wherein opposing faces of the jaws are provided with gripping-surfaces thereon, wherein the gripping surfaces of the jaws have two gripping sections providing differential gripping forces wherein a stop member in the form of a projection extends from one of the jaws to provide a boundary for the first gripping section.

2. A clip hanger as claimed in claim 1, wherein the second or further gripping section is provided from the projection to an inner extremity of the inner surface of the jaws whereby the projection acts as a gripping element.

3. A clip hanger as claimed in claim 1, wherein the clamping member is a resilient member.

4. A clip hanger as claimed in claim 1, wherein the clamping member is a U-shaped member.

5. A clip hanger as claimed in claim 1, wherein the clamping member is sized so that the action of pushing the clamping member into the body squeezes the jaws towards each other.

6. A clip hanger as claimed in claim 1, wherein the faces of the jaws are profiled.

7. A clip hanger as claimed in claim 1, wherein the jaws are formed with textured faces or by addition of gripping material thereon.

8. A clip hanger as claimed in claim 7, wherein the additional gripping material is of rubber or synthetic elastomeric material.

9. A clip hanger as claimed in claim 8, wherein said additional gripping material is itself profiled or textured.

10. A clip hanger as claimed in claim 1, wherein the first gripping section is provided at the free end of the jaws.

11. A clip hanger as claimed in claim 10, wherein the first gripping section comprise pads on the opposing inner surfaces of the jaws.

12. A clip hanger as claimed in claim 11, wherein the pads are of rubber or foamed material.

13. A clip hanger as claimed in claim 1, wherein the second gripping section is profiled or ribbed for grip.

14. A clip hanger as claimed in claim 1, wherein the clamping member is provided with one or more stops thereon to limit the extent to which it can be pushed into the body.

15. A clip hanger as claimed in claim 14, wherein, for a U-shaped clamping member, a stop is provided on an outer face of one or both limbs thereof to abut an edge or edges of the body.

16. A clip hanger as claimed in claim 1, wherein at least one outer face of the clamping member is provided with a thumb or finger receiving recess to facilitate operation of the clip hanger.

17. A clip hanger as claimed in claim 1, wherein both its body and clamp member are made of plastics material.

18. A clip hanger as claimed in claim 1, wherein the body is closed at one end.

19. A clip hanger as claimed in claim 1, wherein the body is open at both ends.

20. A clip hanger as claimed in claim 1, wherein the body is provided with a hook or the like for supporting the hanger on a rail, rack or the like.

21. A garment hanger having two clip hangers as claimed in claim 1, provided either fixed or slidably mounted on opposite ends of arms of the garment hanger, the hanger having a supporting hook generally centrally thereof.

22. A garment hanger as claimed in claim 21, wherein the arms thereof are expandable.

* * * * *